United States Patent [19]

Bromell et al.

[11] 4,179,233

[45] Dec. 18, 1979

[54] VERTICAL MOTION COMPENSATED CRANE APPARATUS

[75] Inventors: Raymond J. Bromell, Dallas; John N. J. Sideris, Grand Prairie, both of Tex.

[73] Assignee: National Advanced Drilling Machines, Inc., Houston, Tex.

[21] Appl. No.: 838,085

[22] Filed: Sep. 30, 1977

Related U.S. Application Data

[63] Continuation-in-part of Ser. No. 815,529, Jul. 14, 1977, abandoned.

[51] Int. Cl.[2] ..... B66C 23/76

[52] U.S. Cl. ..... 414/139; 212/3 R; 254/172

[58] Field of Search ..... 214/12, 13, 14; 212/3; 254/172, 173 R

[56] References Cited

U.S. PATENT DOCUMENTS

| | | | |
|---|---|---|---|
| 2,946,466 | 7/1960 | Weiner | 214/14 |
| 3,104,909 | 9/1963 | Walker | 294/75 |
| 3,871,527 | 3/1975 | Schimmeyer | 212/3 |

FOREIGN PATENT DOCUMENTS

| | | | |
|---|---|---|---|
| 1118048 | 6/1968 | United Kingdom | 214/14 |
| 1224948 | 3/1971 | United Kingdom | 214/14 |
| 1253010 | 11/1971 | United Kingdom | 214/14 |
| 1377485 | 12/1974 | United Kingdom | 214/13 |
| 1413453 | 11/1975 | United Kingdom | 214/13 |
| 1420400 | 1/1976 | United Kingdom | 214/13 |
| 1422023 | 1/1976 | United Kingdom | 214/13 |
| 1476673 | 6/1977 | United Kingdom | 214/13 |

OTHER PUBLICATIONS

"Remote Control Engineering," Nucleonics Nov., 1952, McGraw Hill Publication.

*Primary Examiner*—Trygve M. Blix
*Assistant Examiner*—George F. Abraham
*Attorney, Agent, or Firm*—Jack A. Kanz

[57] ABSTRACT

Disclosed is a crane employing a fluid cylinder and piston assembly secured to the crane boom and operatively interconnected with the cable between the boom sheave and the load hook to vary the vertical distance between the boom sheave and the load hook in response to relative vertical movement between the crane boom and the platform to or from which a load is to be transferred. Sensors which generate a signal in response to vertical movement are associated with each platform which is movable with respect to a fixed horizontal position. Signals from the sensors are used to control the position of the piston in the cylinder and thereby vary the vertical separation between the hook and the boom in relation to relative vertical movement between the boom and the landing platform.

15 Claims, 7 Drawing Figures

VERTICAL MOTION COMPENSATED CRANE APPARATUS

This is a continuation-in-part of application Ser. No. 815,529 entitled "Vertical Motion Compensated Crane Apparatus" filed July 14, 1977 and assigned to the same assignee, which application is now abandoned.

This invention relates to apparatus and methods for transferring loads between two platforms which are vertically movable relative to each other. More particularly, it relates to load transfer apparatus mounted on one platform and adapted to land a load on or remove a load from another platform, which apparatus includes relative vertical motion compensation apparatus to substantially reduce or cancel the effect of relative vertical movement of the two platforms.

Many operations involve the transfer of a load suspended on a tensioned cable from a first platform to a second platform. Typically, the first and second platforms are fixed relative to each other and such transfers may be accomplished with relative ease. However, in many situations such as marine operations or the like, the first and second platforms may be vertically movable relative to each other and the relative vertical movement may not be predictable with exact certainty or uniformity. For example, in transferring a load from a pier to a floating vessel or vice versa, the floating vessel may move vertically in response to waves, tides, etc. while the pier remains fixed. Accordingly, relative vertical movement between the ship deck and a crane mounted on the pier may cause difficulty in gently landing a load on the deck. The problem becomes even more acute in offshore operations where loads may be transferred between a floating barge and an offshore platform which is secured to the ocean floor. In such offshore operations, the wave action may be more severe and less predictable. Furthermore, offshore operations must often be carried out in rough weather wherein the heavy sea action makes such transfers extremely difficult. To further complicate the problem, many such load transfer operations involve the transfer of extremely heavy equipment, on the order of 1,000 tons, which equipment is very expensive and shock sensitive and may be seriously damaged unless landed on the receiving platform very carefully. Offloading from a ship or barge subject to vertical movement onto a fixed or floating platform on which the crane is mounted can also be extremely dangerous. If the hook is lowered to the deck of the barge for attaching to the load while the barge is at the bottom of a swell, the barge deck will rise as the swell rises and thus contact and raise the hook. The cable suspended from the crane then becomes slack and may loop or become entangled with other cargo, personnel, or structure of the barge. When the barge sinks into the next valley between the swells, the hook is lowered with the barge deck and the cable again drawn taut, thus endangering other cargo, personnel and the like with which the slack cable may have become entangled. To avoid this problem crane operators usually attempt to raise and lower the hook in synchronization with the pitching deck. However, attempts at manually coordinating hook movement with a pitching deck are notoriously ineffective.

Similar problems exist in attempting to transfer loads between two floating platforms such as the decks of two floating ships, one of which carries the crane. In this case both platforms may move vertically with respect to each other and with respect to a fixed horizontal position, thus rendering the transfer between such independently moving platforms extremely difficult. Various other marine operations, such as laying pipe on the ocean floor from a floating barge or landing submerged equipment on the ocean floor or submerged platforms from a floating vessel involve similar difficulties.

Prior attempts to overcome the difficulties involved rely mainly on means for maintaining a constant tension on the hoist load line. Such systems, however, suffer from inherent limitations. Conventional line tensioning apparatus operates on the line between the winch and the crane boom. Therefore, when multiple-reeved tackle is employed between the load hook and the crane boom the length of line between the crane boom sheave and the winch (known as the 'fast line') which must be adjusted to maintain a constant tension on the line at the load is a multiple of the vertical distance which must be compensated. Furthermore, while such line tensioning apparatus may aid in lifting a load from a moving platform with a crane positioned on a fixed platform, such line tensioning offers no way to synchronize vertical movement of a load suspended from a crane on a fixed platform with vertical movement of a moving platform so that the load may be gently landed on the moving platform. Accordingly, maintaining constant tension on a load line will not prevent the load from being smashed into a rapidly vertically rising deck.

Hook-mounted relative motion compensation apparatus which adjusts the distance between the end of the crane boom and the load hook in response to vertical movement of the landing platform may be devised which overcome some of the difficulties involved. However, such motion compensation apparatus, in order to be sturdy enough to support the weight of heavy loads, must itself be quite heavy. Furthermore, where such hook-mounted motion compensation apparatus is employed, the hydraulic cylinder assemblies as well as the motors and pumps necessary to drive the apparatus must also be carried in the motion compensation apparatus itself, thus further increasing the weight of the motion compensation apparatus. Since such motion compensation apparatus must be supported by the load line, the lifting capacity of the crane is reduced. Furthermore, such motion compensation apparatus must be suspended at the end of the load line near the hook so that the motion compensation apparatus will not substantially interfere with the height capacity of the crane. Large, bulky and heavy motion compensation apparatus suspended from the end of a load line may become difficult to maneuver in rough seas because of the action of the wind thereon. Furthermore, in situations where the crane is supported on a floating platform, oscillatory movement of the floating platform may be transferred to the suspended motion compensation apparatus and amplified, thus causing the motion compensation apparatus to sway and oscillate horizontally. Because of the mass of the motion compensation apparatus suspended on the end of the cable, such oscillatory motion can be dangerous and difficult to control in certain situations.

While a hook-mounted motion compensation system offers some distinct advantages, it inherently incorporates its own unique disadvantages. Accordingly, it is desirable to provide motion compensation apparatus which avoids the disadvantages of the hook-mounted motion compensation devices.

In accordance with the present invention vertical motion compensation apparatus is provided which is attached to the crane boom and operates only on the load line between the boom and the load hook. Since the motion compensation apparatus is secured to the boom, the pumps and motors necessary to activate the motion compensation apparatus may be carried on the crane platform and the high pressure fluid transferred to the motion compensation cylinder by a pressure line carried by the crane boom. Accordingly, the mass of the portion of the motion compensation apparatus carried by the boom is substantially reduced. Likewise, the physical size of the motion compensation apparatus carried by the boom is substantially reduced, thus the total lift capacity of the crane is not substantially impaired. Furthermore, since the motion compensation apparatus is attached to the boom itself, it is not subject to excessive wind loading problems or extreme oscillation caused by movement of the platform on which the crane is mounted.

The motion compensation cylinder of the invention may be attached between the end of the load line and the end of the crane boom. In this case, the load hook means is suspended from the cable looped between the crane boom and the motion compensation cylinder. The motion compensation apparatus must then support only one-half the weight of the load and must move the end of the cable vertically only twice the vertical distance to be compensated. Alternatively, the apparatus may include a sheaved travelling block (load sheave) carrying the load hook and a sheaved block carried by the motion compensation cylinder. In this arrangement, the motion compensation apparatus must support more of the weight of the load (depending upon the number of reeves) but only need to move vertically approximately the vertical distance to be compensated. Since the entire reeved cable and both sheave blocks are supported by a piston in the motion compensation cylinder supported by the boom, vertical movement of the piston in proportion to relative vertical movement of the second platform eliminates undesired relative movement of the hook with respect to the landing platform. The load may thus be gently landed on a pitching platform by normal operation of the crane controls. Furthermore, in off-loading operations where a hook is lowered to be affixed to the cargo, a constant tension is maintained on the load cable regardless of the relative vertical movement of the two platforms by maintaining the load hook a minimum distance from the moving deck regardless of relative vertical movement of the two platforms.

In yet another alternative embodiment, the vertical motion compensation cylinder may be mounted parallel with the longitudinal axis of the boom and preferrably within the structure of the boom itself. In this embodiment a sheaved block carried on the end of a piston rod extending from the cylinder engages the load line between the load hook and the boom sheave and draws the load line over an idler sheave and into the boom structure to raise the load hook with respect to the boom.

The motion compensation apparatus of the invention may be incorporated into existing cranes with minimum modification. Furthermore, if the compensation cylinder is mounted vertically, it may be mounted partially extending above the boom. Accordingly, the height capacity of the crane is virtually unaffected and the lift capacity of the crane is not substantially reduced. If the cylinder is mounted horizontally (within the boom), height capacity is unaffected. When vertical motion compensation is not required, the apparatus may be de-activated and the crane operated in the conventional manner unaffected by the compensation apparatus.

Other features and advantages of the invention will become more readily understood when taken in connection with the appended claims and attached drawings in which:

It should be appreciated that the principles of the invention are applicable to any load transfer operation wherein a suspended load is transferred between two platforms, one of which is vertically movable with respect to the other. For purposes of illustration, the invention is described herein with respect to transferring loads between a floating vessel, such as a ship or barge, and a fixed platform, such as an offshore drilling platform or a pier, and between two floating vessels. Accordingly, the term "platform" is used herein to mean a surface to or from which a load is to be transferred and may encompass the surface of a pier, an offshore platform, the deck of a ship or barge, the ocean floor, or any other surface to or from which a load may be transferred. Likewise, the term "crane" is employed herein in its broadest sense to describe any structure from which a load line, such as a cable, is suspended to raise or lower a load. It will be understood, therefore, that a crane may take many forms. Ordinarily, however, the crane employs a structure known as a boom which extends from the base of the crane to a point over the platform from or to which the load is to be transferred. A motor-driven winch carried by the crane reels in or plays out a cable passing through a boom sheave at the end of the boom to raise or lower the load hook. Such cranes are well known in the art and the operation of same will not be discussed in detail herein.

Figure 1:
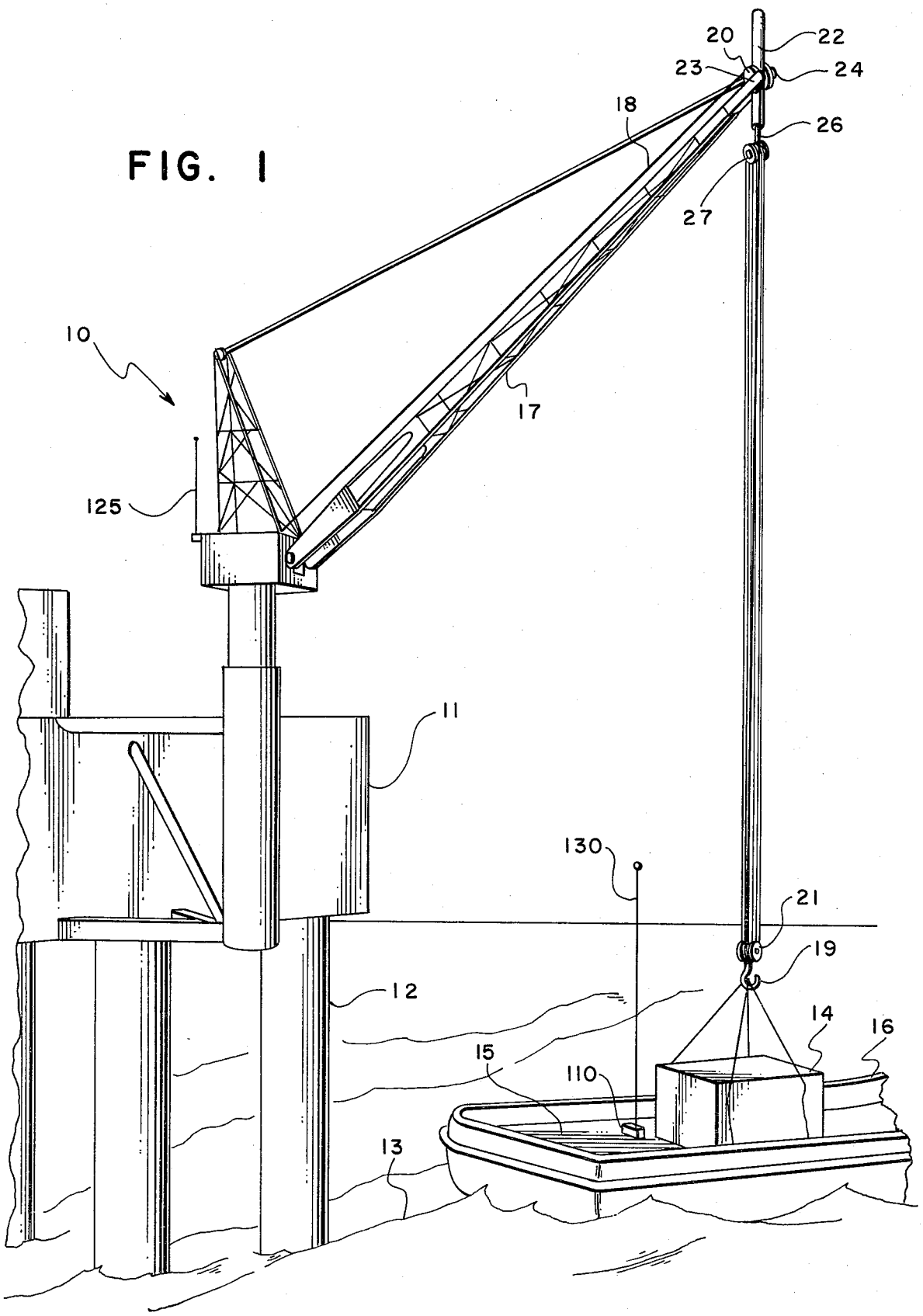
FIG. 1 is a pictorial illustration of a crane employing one embodiment of the invention.

In accordance with the invention a vertical motion compensation apparatus is incorporated into a crane to automatically adjust the distance between the load hook and the boom directly above the load hook in response to relative vertical movement of the crane and the platform to or from which a load is to be transferred. One preferred embodiment of the invention is illustrated in FIGS. 1, 2, 3 and 5. As illustrated in FIG. 1, a crane, generally indicated at 10, is mounted on an offshore platform 11. The offshore platform 11 may be any of various types of structures which are secured to the ocean floor by legs 12 to support the platform 11 at a stable fixed elevation above the surface 13 of the ocean. As illustrated in FIG. 1, the crane 10 is employed to transfer a load 14 to or from the deck 15 of barge 16. The crane 10 is generally adapted to provide horizontal movement of the load with respect to the deck of the platform 11 so that loads lifted from the deck 15 of the barge may be placed on the deck of the platform 11 or vice versa. To provide such horizontal movement the crane may be mounted on tracks or pivotally mounted so that it may be rotated in the horizontal plane of the deck of the platform. Various other means may be employed to provide horizontal movement of the load 14.

Crane 10 employs a boom 17 which extends therefrom so that the end of the boom 17 may be positioned over the barge 16. The crane 10 includes a motor-driven winch (not illustrated) to haul in and play out a cable 18 which passes over a sheave at the end of the boom and supports the load hook 19 to which the load 14 may be secured. In simple conventional cranes, the sheave may be a single grooved pulley and the load hook 19 secured to the end of the cable. However, heavier cranes employ a multiple-sheaved stationary block at or near the end of the boom and a multiple-sheaved travelling block 21 between which the cable is reeved to obtain the mechanical advantage of multiple-reeved tackle. In such cases, the load hook 19 is secured to the travelling block 21. In cranes employing a multiple reeved block arrangement as described above, the portion of the cable between the boom sheave (stationary block) and the winch is known as the 'fast line' since the linear distance this section of the cable moves is a multiple of the vertical distance the hook moves.

It will be readily appreciated that little difficulty is encountered in transferring a load from the platform 11 to deck 15 of barge 16 when the sea is calm. However, since the load 14 is suspended on a tensioned cable from a crane secured to a fixed platform, the load 14 moves vertically only as the fast line is operated by the winch. Since the barge 16 is floating on the surface of the ocean, the deck 15 will rise and fall with respect to the fixed platform as the barge rises and falls with ocean waves. Accordingly, unless the vertical movement of the load 14 is synchronized with the vertical movement of the deck 15, the deck 15 may rise rapidly and contact the load 14 when the crane operator is attempting to lower the load onto deck 15. Conversely, when the crane operator is attempting to remove a load from the deck 15, the vertical movement of the empty load hook must be synchronized with the vertical movement of the deck 15 in order to prevent the hook from resting on deck 15 and permitting the cable to become slack.

In accordance with the invention, the crane 10 is provided with a vertical motion compensation apparatus secured to the boom and acting only on the cable between the boom and the load hook in response to vertical movement of the deck 15. In the embodiment illustrated in FIGS. 1, 2 and 3, the vertical motion compensation apparatus comprises a hydraulic piston and cylinder assembly supported by the boom which is activated by a hydraulic pump in response to the vertical movement of the barge deck 15. In the preferred embodiment, the vertical motion compensation apparatus comprises a hydraulic cylinder 22 positioned vertically and pivotally secured between the lateral members 23 and 24 of the boom 17. The pivot axis of the cylinder is coaxial with a boom sheave 20. Boom sheave 20 is free to rotate independently of the cylinder and the cylinder may likewise rotate in the vertical plane independently of the boom sheave 20.

A piston is mounted for reciprocal movement within cylinder 22 and attached to the end of a piston rod 26 which extends through the bottom end of the cylinder 22. A multiple-sheaved stationary block 27 is secured to the free end of rod 26. The term "stationary block" is used herein in the normal sense to define a portion of a multiple reeved tackle arrangement which is stationary with respect to the travelling block. As will be described herein, the stationary block is not in fact stationary since it will be moved vertically by the motion compensation apparatus. The cable 18 from the winch passes over boom sheave 20 to a multiple-sheaved travelling block 21 and is reeved about block 27 and travelling block 21 in the conventional manner. A load hook 19 depends from the travelling block 21.

It will thus be apparent that when the piston is held stationary with respect to the cylinder 22, the crane 10 may be operated in the conventional manner. The fast line sheave 20 is physically spaced from the stationary block 27 (which now operates as the boom sheave); but in all respects the crane functions are conventional. However, if the fast line is held stationary, the load hook may be moved vertically by moving the piston within the cylinder 22. Accordingly, the cylinder and piston assembly may operate independently of the fast line to vary the vertical position of the hook relative to the boom. Likewise, the fast line and the cylinder assembly may be operated at the same time to collectively vary the position of the load hook. It should be observed that the weight of the load is substantially supported by the piston rod 26. Accordingly, since the cylinder is pivotally mounted the cylinder 22 will be held in the vertical position by the weight of the tackle blocks, cable and hook irrespective of horizontal or vertical movement of the boom. Furthermore, since a substantial portion of the length of the cylinder is positioned above the pivot point, the piston may be withdrawn into the cylinder to raise the block 27 near the end of the boom, thus the lift height capacity of the crane is virtually unaffected by the motion compensation apparatus. Unless alternate means are used to maintain the cylinder in the vertical position, the pivot point should be above the center of gravity of the cylinder and piston assembly when supporting an unloaded hook.

Figure 5:
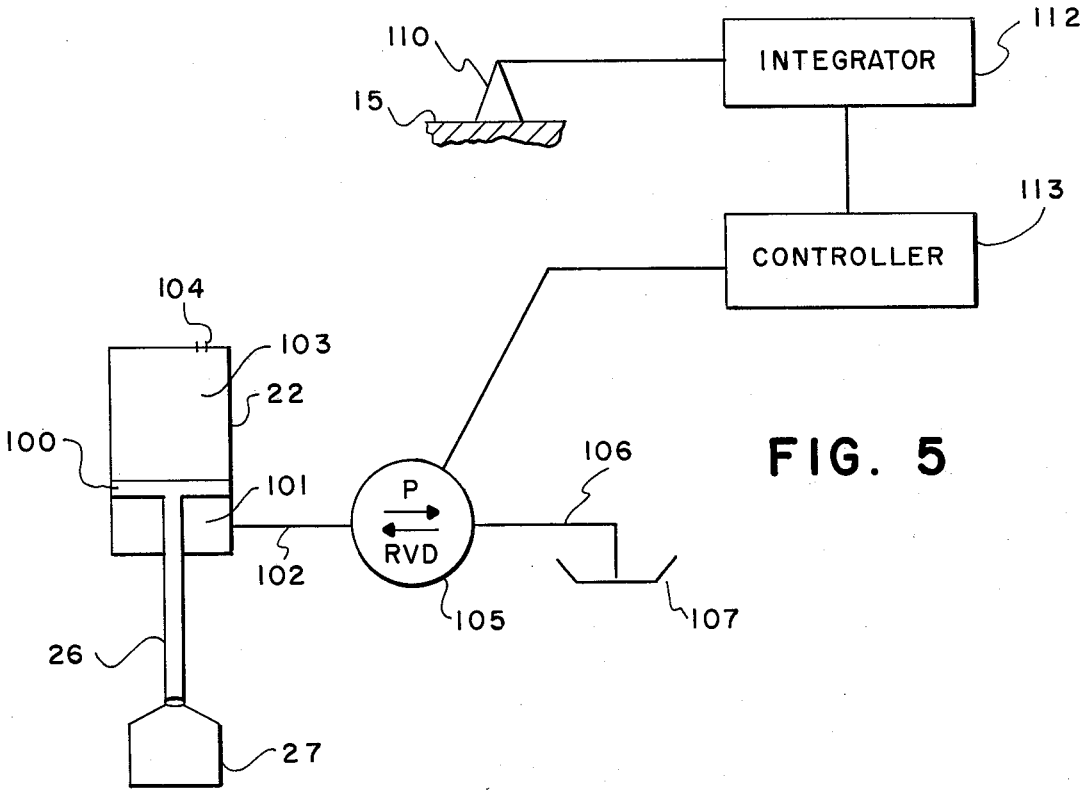
FIG. 5 is a schematic illustration of a control system for the motion compensation apparatus.

Control apparatus for the motion compensation apparatus of FIG. 1 is illustrated schematically in FIG. 5. As discussed above, the hydraulic cylinder 22 is mounted on the crane boom. The cylinder 22 carries a reciprocal piston 100 connected to rod 26 which supports the stationary block 27. Hydraulic fluid is supplied to the chamber 101 below the piston by a high pressure line 102. The chamber 103 above the piston 100 is vented to atmosphere by vent 104. If desired, the vent 104 may communicate by conduit (not shown) with the hydraulic fluid reservoir to maintain a constant pressure on the reservoir.

In the preferred embodiment, hydraulic fluid is supplied to high pressure line 102 by a reversible variable displacement pump 105. Such pumps are well known in the art as over-center pumps and adapted to pump hydraulic fluid in either direction between lines 102 and 106. The direction in which the fluid is pumped and the rate at which it is pumped is determined by the capacity of the pump and the position of the control yoke. Thus, by positioning the yoke in one direction hydraulic fluid is pumped from reservoir 107 through line 106 and into chamber 101 through high pressure line 102. By reversing the control yoke, hydraulic fluid is pumped in the reverse direction. Accordingly, stationary block 27 is vertically raised or lowered by appropriately positioning the control yoke.

According to the above-described embodiment of the invention, the stationary block 27 is raised or lowered in synchronization with vertical movement of the landing platform 15 when the boom is over the barge. Where the crane is mounted on a fixed platform and the landing platform is vertically movable relative thereto as in the situation depicted in FIG. 1, a sensor is placed on the movable platform to detect vertical movement of the movable platform with respect to the fixed platform. In the preferred embodiment, an accelerometer 110 is placed on the movable platform to detect relative vertical movement of the platform 15. The signal generated by the accelerometer in response to vertical movement of the platform 15 indicates direction of movement and acceleration. This signal is transmitted to a signal processor 112 which integrates the signal to determine the rate or average velocity of movement of the platform and generate an appropriate signal which is transmitted to a controller 113. Controller 113 operates in response to the signal received from the integrator 112 to generate a signal which controls the position of the control yoke of pump 105. Accordingly, when upward movement in the vertical direction is detected by accelerometer 110, the accelerometer generates a signal which is transmitted to the integrator 112 which in turn transmits a signal to controller 113 and controller 113 causes the pump to be stroked in the forward direction. Pump 105 then pumps hydraulic fluid from reservoir 107 to chamber 101 to cause the hook 19 to rise. In similar fashion, when accelerometer 110 detects vertical movement in the downward direction, the signal generated by accelerometer 110 is processed by the integrator 112 and controller 113 which causes the pump to be yoked in the opposite direction and pump fluid from chamber 101 to reservoir 107 and lower the hook 19.

Figure 6:
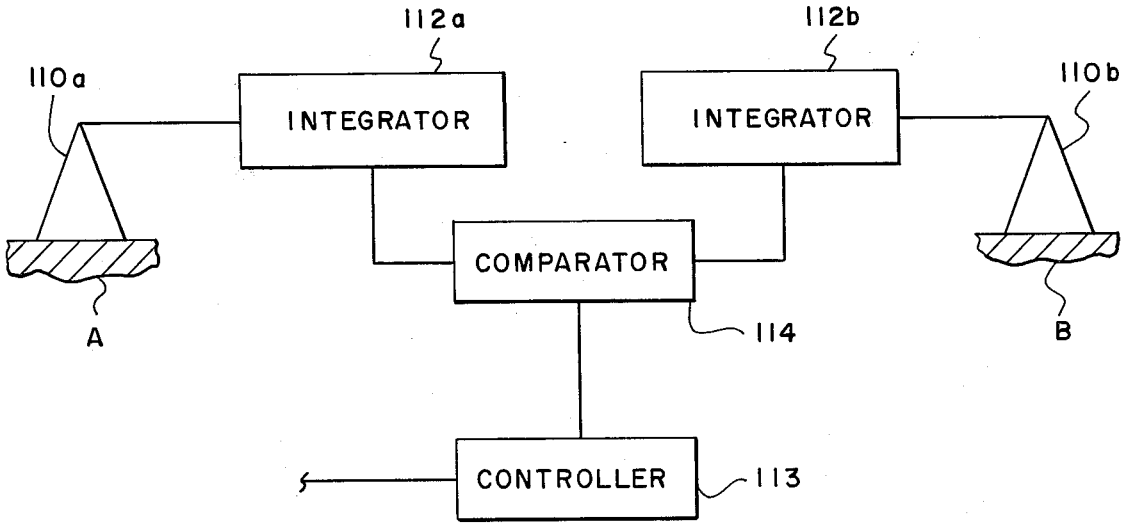
FIG. 6 is a diagramatic illustration of a control system for the apparatus of the invention where both platforms are vertically movable with respect to a fixed horizontal position.

From the foregoing it will be apparent that when the crane is on a fixed platform the sensor 110 must be situated to detect relative vertical movement of the landing platform. Accordingly, when an accelerometer is used as a sensor 110, the accelerometer is placed on the movable platform. Conversely, when the crane is on a movable platform and used to land or remove a load from a fixed platform, the sensor must determine relative vertical movement of the crane. In this situation an accelerometer is most appropriately placed on the upper end of the crane boom as shown at **110*b* in FIG. 2**.

Where the crane is on a vertically movable platform and the landing platform is also vertically movable, as when the crane is mounted on a barge and attempting to land or offload cargo from another barge, it is necessary that the relative vertical movement of the two platforms must be detected. Suitable control apparatus for the motion compensation apparatus described is shown in FIG. 6. Since both platforms A and B are vertically movable, sensors, such as accelerometers **110*a* and 110*b*, are positioned on each platform. Ordinarily, one sensor would be placed on the landing platform and the other sensor would be placed on the crane boom near the boom sheave so that vertical movement of the boom sheave is detected. Signals generated by the sensors 110*a* and 110*b* are transmitted to appropriate signal processors, such as integrators 112*a* and 112*b*, respectively. The signals generated by the integrators 112*a* and 112*b* are fed to a comparator 114 which determines the vertical movement of the platforms with respect to each other and sends an appropriate signal to controller 113 which then appropriately controls the position of the control yoke of pump 105**.

If desired, the sensor used for detecting movement of the crane platform may be mounted on the travelling block 21. In this arrangement the motion compensation apparatus is activated only when it is desired to maintain the hook at a fixed position relative to the landing platform, as when a hook is lowered to a landing platform for attachment to the load. Once the crane operator has positioned the hook at the desired relative position the motion compensation apparatus is activated to maintain the hook at a fixed position relative to the landing platform irrespective of relative movement between the boom and the landing platform.

It should be noted that when the crane is mounted on one platform (such as a fixed platform) and is used to transfer loads from a moving platform to the fixed platform on which the crane is mounted, the motion compensation apparatus must be deactivated after the load has been lifted from the moving platform. Otherwise, the load will continue to move vertically in response to the pitching motion of the landing platform. Accordingly, activation and deactivation controls should be available to the crane operator so that the crane operator can activate the compensation apparatus only when it is required. Likewise, when the crane is mounted on one platform and used to transfer loads between second and third platforms, both of which are vertically movable with respect to the crane platform (as when a crane on a fixed platform is used to transfer loads between two floating vessels), the sensor used to detect vertical movement of the landing platform must be transferred between the two movable platforms or each movable platform provided with a separate sensor and means provided by which the crane operator may select between the sensors controlling the motion compensation apparatus as required.

While the invention has been described with particular reference to the use of accelerometers for detecting relative vertical movement of the platforms, it will be readily appreciated that other sensing means suitable for detecting relative vertical movement may be employed. Various other sensing apparatus will be readily apparent to those skilled in the art and may be substituted for the accelerometer control systems described herein without departing from the spirit and scope of the invention. It should further be recognized that the electronic signal processing required to convert a signal from the sensor to an appropriate signal to control the control yoke of the pump will be dependent upon type of sensor used. Various control circuits for performing such operations may be readily devised by those skilled in the art.

When an accelerometer is used to detect relative vertical movement of the platforms as described hereinabove, the accelerometer must be placed on the moving platform. If the landing platform is stable and the platform supporting the crane is vertically movable, the sensor is placed on the platform on which the crane is mounted. In this case the accelerometer is conveniently placed on the crane boom near the boom sheave so that relative vertical movement of the crane directly above the landing platform is detected. However, when the crane is on a fixed platform and the landing platform is movable with respect thereto, the accelerometer must be placed on the landing platform. In the preferred embodiment the signal from the accelerometer is converted to an appropriate telemetry signal which may be transmitted by radio signal from antenna 130 on the sensing and signaling device 110 to a receiving antenna 125 mounted on the crane. Alternatively, the signal from the accelerometer can be transmitted directly to signal processing equipment aboard the crane by a suitable electrically conductive cable suspended from the landing platform to the crane. Other means for transmitting the signal to the control apparatus will be apparent to those skilled in the art and may be adapted as required to accomodate other sensing means.

As described above, the motion compensation cylinder supports the entire weight of the load except for that portion supported by the fast line. Accordingly, the cylinder should have the lift capacity required to handle any load to be lifted by the crane. The stroke of the cylinder, of course, should be sufficient to equal the vertical movement to be compensated. The performance capacity of the pump or pumps necessary to raise the load will depend on the size of the cylinder, the anticipated load, and the anticipated rise rate. The size and capacity of pumps, cylinders and the like necessary to produce the required lifting capacity, however, may be readily determined and matched with appropriate sensing and control apparatus to raise and lower the hook in direct relation to the signal received from the motion sensor selected.

Since the motion compensation cylinder acts only on the cable between the crane boom and the load, the distance which the piston moves is directly related to but not necessarily equal to the movement sensed. For example, if the fast line is held steady while the piston is raised in the embodiment illustrated in FIG. 1, the distance the stationary block 27 is raised is not equal to the distance the hook block 21 is raised since the fast line is not moved with the stationary block. This variance, however, is directly related to the number of reeves and may be readily compensated for in the control circuits. As the number of reeves is increased the variance decreases.

Figure 2:
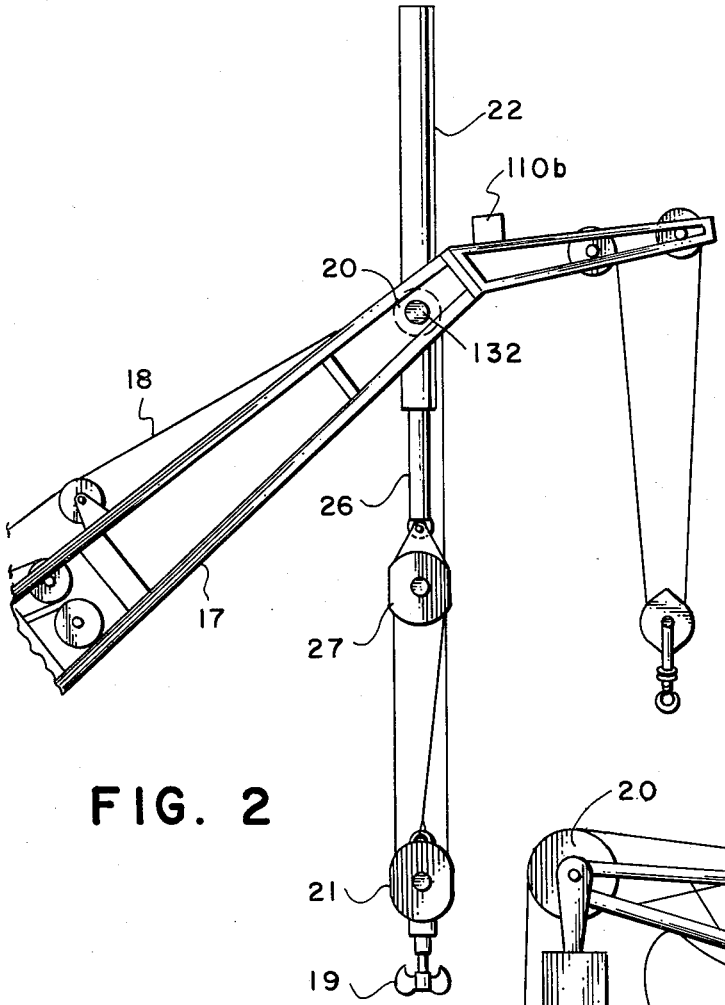
FIG. 2 is an elevational view of the motion compensation apparatus of the invention mounted on the end of a crane boom with the cylinder swivel mounted to remain vertical.
Figure 3:
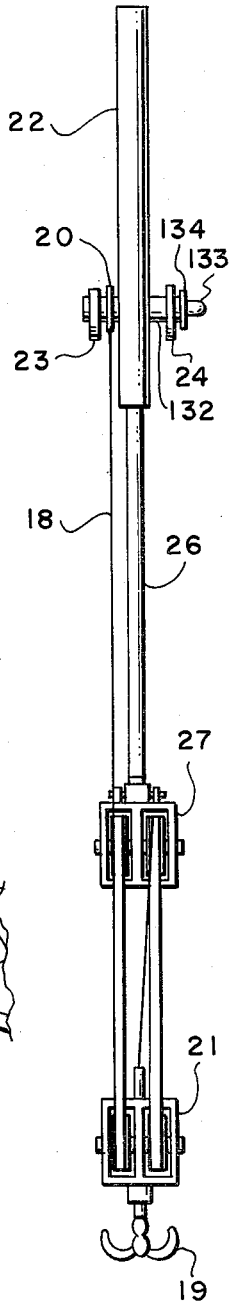
FIG. 3 is an end view of the apparatus of FIG. 2.

By supporting the motion compensation cylinder 22 between the lateral members 23 and 24 to pivot about the axis of the boom sheave 20 as illustrated in FIGS. 1, 2 and 3, additional advantages are obtained. For example, hydraulic fluid may be conducted from the pump to the cylinder 22 through a fixed hard pressure line 133 secured to or forming part of the boom 17. Furthermore, the fluid may be injected directly into the cylinder through the pivot pin 132 supporting the cylinder 22 through a swivel connector 134, thus totally eliminating the use of flexible pressure hoses in the hydraulic system.

Figure 4:
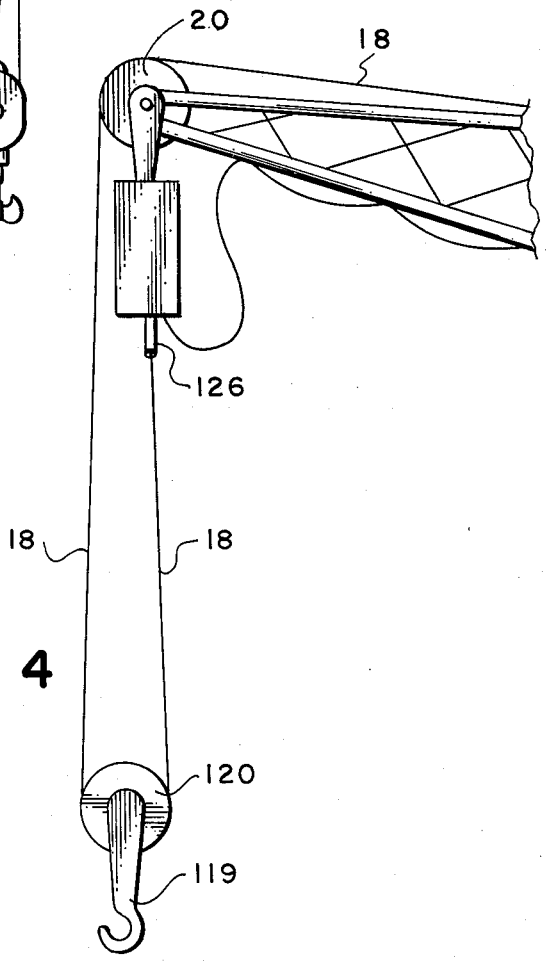
FIG. 4 is an elevational view of an alternate embodiment of the compensation apparatus of the invention with the cylinder mounted between the end of the load line and the boom.

An alternative embodiment of the invention is illustrated in FIG. 4. In this embodiment the cable 18 passes over the boom sheave 20 and through a single grooved travelling block 120. The end of the cable is attached to the piston rod 126. It will thus be observed that in this embodiment only one-half of the weight of the load is supported by the cylinder 122. However, the piston must travel twice the distance that load hook 119 travels. In this embodiment the cylinder 122 is suspended directly from the pivot axis of the boom sheave 20, thus the motion compensation cylinder, if excessively long, may interfere with the lift height capacity of the crane. However, the embodiment illustrated in FIG. 4 may be more readily adapted to the existing crane equipment. It will be understood that the piston rod 126 may support a multiple-sheaved stationary block and a multiple-sheaved hook block as shown in FIG. 1. Furthermore, the cylinder need not depend from the axis of the boom sheave but may depend from some other portion of the boom.

It is not necessary that the pumps be capable of supplying sufficient pressure to lift the entire weight of the load if the motion compensation apparatus is only required to coordinate the movement of an empty load hook with the movement of a pitching deck as when attempting to remove cargo from a pitching deck with a fixed crane. For example, the motion compensation apparatus need only be sufficient to raise and lower the load hook in synchronization with the pitching deck. Accordingly, as the load is lifted, the weight on the piston may overcome the pressure in the cylinder and cause the piston to rest on the bottom of the cylinder. In this case the motion compensation apparatus acts merely as a line tensioning means to maintain constant tension on the cable supporting the empty load hook so that load hook movement may be coordinated with the movement of a pitching deck while attaching the load hook to a cargo to be lifted. Once the crane is operated to lift the cargo, the piston contacts the bottom of the cylinder and the crane operates in its normal fashion.

For handling light loads or when operating only as a cable tensioning apparatus, it is not necessary that the cylinder be operated with hydraulic fluid. Pneumatic cylinders may suffice for light load operations and offer quicker response than hydraulic systems.

Figure 7:
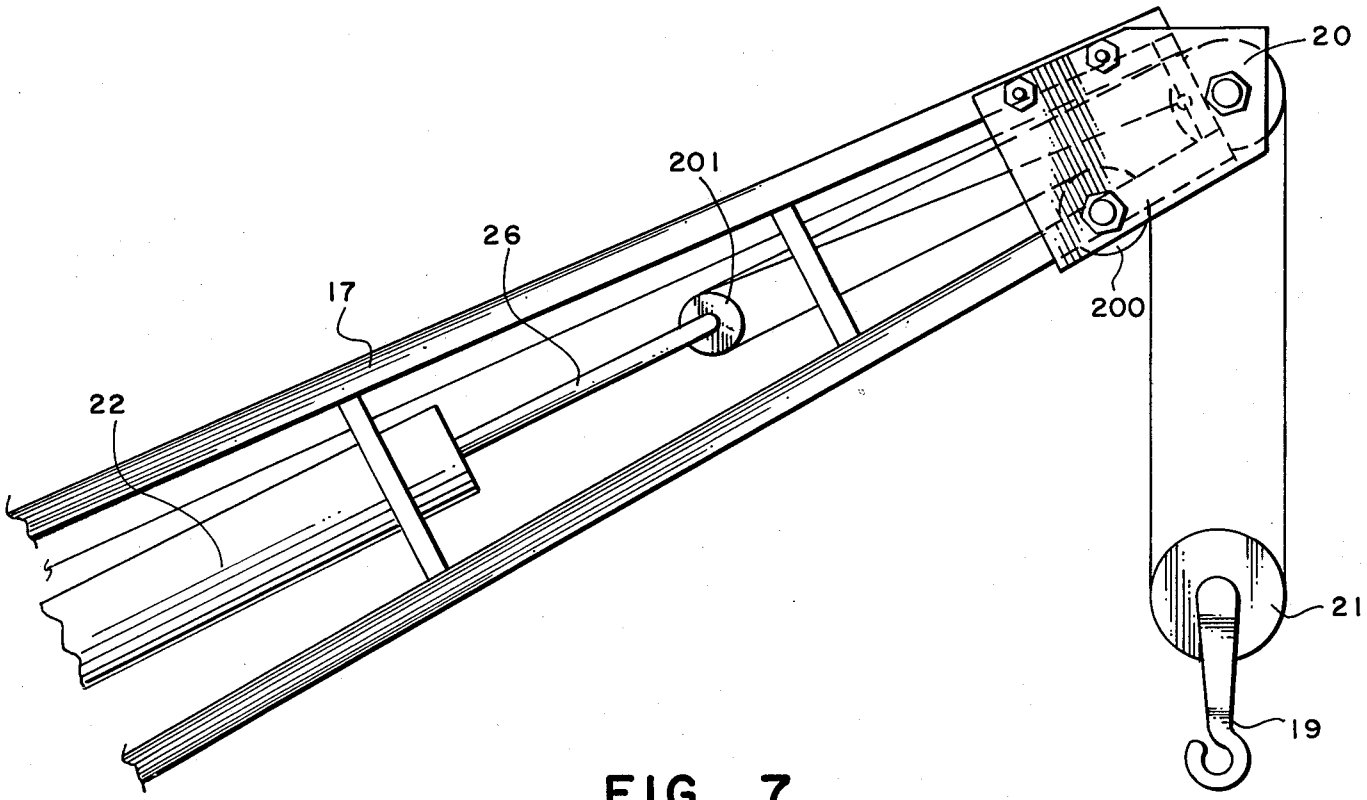
FIG. 7 is an elevational view of an alternative embodiment of the invention wherein the compensation cylinder is mounted within and parallel with the crane boom.

Another embodiment of the invention is illustrated in FIG. 7. In this embodiment the cylinder 22 is mounted within and parallel with the boom 17. The cable 18 is reeved in conventional manner around the boom sheave (stationary block) 20 and the travelling block 21 which supports the load hook 19. The boom 17 is modified, however, to include an idler sheave 200, preferably below and inboard from the boom sheave 20 as illustrated.

A piston rod 26 transversely moveable with respect to the boom 17 extends from the cylinder 22 and carries a compensating sheave 201 on the free end thereof. The compensating sheave 201 is positioned to engage the inboard cable reeved between boom sheave 20 and travelling block 21. Thus, as the piston rod 26 is withdrawn into cylinder 22, the cable reeved between the boom sheave 20 and travelling block 21 is drawn over the idler sheave 200 and boom sheave 20, effectively varying the distance between boom sheave 20 and travelling block 21 in direct proportion. to the lateral movement of the compensation sheave 201. Since the compensation sheave 201 does not engage the fast line, the embodiment of FIG. 7 is the mechanical equivalent of the embodiment of FIG. 2 with regard to the effect of movement of the piston to raise and lower the hook. This embodiment, however, offers the additional advantages of requiring only minimum modification of the boom structure and, since the cylinder is mounted parallel with the boom and does not vary the location of the original boom sheave 20 of the crane, vertical lift capacity of the crane is completely unaffected by the modification. Furthermore, since the load is supported directly by the idler 200 and boom sheave 20, the piston rod and cylinder are isolated from side loads caused by horizontal movement of the boom or load. The boom must only be modified so that the idler 200 as well as the boom sheave 20 may support the anticipated load and to accomodate the cylinder within the boom.

Use of a fluid system to compensate for relative vertical movement as described herein provides a unique safety feature. In many instances a crane operator attempting to off-load a cargo package from a moving barge deck with a crane mounted on a fixed deck (or vice versa) may inadvertently hook onto the barge itself while the barge is riding the crest of a wave. As the wave subsides, the barge is rapidly lowered with respect to the crane. If the hook has accidentally engaged the barge rather than the cargo, the crane is subjected to the entire weight of the barge. This usually results in damage to the crane, the barge, or both. However, the high pressure line 102 between the pump 105 and the cylinder may be provided with a pressure relief valve which vents to the reservoir when the weight on the hook exceeds a predetermined amount. Accordingly, if the hook engages the barge and the hook is subjected to loads greater than the load capacity of the crane, the relief valve vents and the piston is permitted to be lowered with respect to the cylinder, thus permitting the hook to be lowered with the barge without overloading the crane.

From the foregoing it will be apparent that the principles of the invention may be employed with various load transfer apparatus where compensation of relative vertical movement is desired. It will be understood, therefore, that although the invention has been described with particular reference to specific embodiments thereof, the forms of the invention shown and described in detail are to be taken as preferred embodiments of same, and that various changes and modifications may be resorted to without departing from the spirit and scope of the invention as defined by the appended claims.

What is claimed:

1. Load transfer apparatus comprising:

(a) boom means secured to a first platform and extending over a second platform, (b) hoist means comprising a winch, a boom sheave secured to said boom means above said second platform, and a cable secured to said winch and passing over said boom sheave to support load hook means above said second platform, (c) relative vertical motion compensation means secured to said boom means comprising a cylinder and piston assembly operative to vary the vertical distance between said boom sheave and said load hook means in response to relative vertical movement between said first platform and said second platform, (d) means to selectively supply fluid to and remove fluid from said cylinder, thereby to raise and lower said piston in said cylinder, (e) first sheave means supported by said piston, (f) second sheave means supporting said load hook means, said cable being reeved between said first and second sheave means, (g) sensing means to detect relative vertical movement between said first platform and said second platform and generate a signal in response to said relative movement, and (h) control means responsive to said signal and operative in response thereto to control said means to selectively supply fluid to and remove fluid from said cylinder.

2. Load transfer apparatus comprising:

(a) boom means secured to a first platform and extending over a second platform, (b) hoist means comprising a winch, a boom sheave secured to said boom means above said second platform, and a cable secured to said winch and passing over said boom sheave to support load hook means above said second platform, and (c) relative material motion compensation means secured to said boom means comprising a cylinder and piston assembly operative to vary the vertical distance between said boom sheave and said load hook means in response to relative vertical movement between said first platform and second platform, said motion compensation means attached between the end of said cable and said boom means, and said load hook means suspended from said cable between said boom sheave and said motion compensation means.

3. Load transfer apparatus comprising:

(a) boom means secured to a first platform and extending over a second platform, (b) hoist means comprising a winch, a boom sheave secured to said boom means above said second platform, and a cable secured to said winch and passing over said boom sheave to support load hook means above said second platform, and (c) relative vertical motion compensation means secured to said boom means comprising a cylinder and piston assembly pivotally mounted on said boom means with the pivotal axis of said cylinder coaxial with said boom sheave and operative to vary the vertical distance between said boom sheave and said load hook means in response to relative vertical movement between said first platform and said second platform.

4. Load transfer apparatus comprising:

(a) boom means secured to a first platform and extending over a second platform, (b) hoist means comprising a winch, a boom sheave secured to said boom means above said second platform, and a cable secured to said winch and passing over said boom sheave to support load hook means above said second platform, and (c) relative vertical motion compensation means secured to said boom means comprising a cylinder and piston assembly operative to vary the vertical distance between said boom sheave and said load hook means in response to relative vertical movement between said first platform and said second platform wherein said piston is connected to a rod, said rod supports a first sheave block, and said cable from said winch passes over said boom sheave, through a second sheave block which supports said load hook means and through said first sheave block.

5. Load transfer apparatus as defined in claim 4 including:

(a) pump means to selectively supply hydraulic fluid to and remove hydraulic fluid from said cylinder, thereby to selectively move said first sheave block relative to said boom means, (b) sensing means to detect vertical movement of said second platform relative to said first platform and generate a signal in response to said movement, and (c) control means responsive to said signal and operative in response thereto control said pump means.

6. Load transfer apparatus as defined in claim 5 wherein said sensing means is a accelerometer.

7. Load transfer apparatus as defined in claim 5 wherein said sensing means is mounted on said second platform.

8. Load transfer apparatus as defined in claim 5 wherein said sensing means is mounted on said first platform.

9. Load transfer apparatus as defined in claim 5 wherein said sensing means is mounted on said boom means near said boom sheave.

10. Load transfer apparatus as defined in claim 5 wherein first sensing means is mounted on said first platform, second sensing means is mounted on said second platform, and said control means is responsive to signals from both said first and second sensing means and operative in response thereto to control said pump means.

11. Load transfer apparatus comprising:

(a) boom means secured to a first platform and extending over a second platform, (b) hoist means comprising a winch, a boom sheave secured to said boom means above said second platform, and a cable secured to said winch and passing over said boom sheave to support load hook means above said second platform, (c) relative vertical motion compensation means secured to said boom means comprising a cylinder and piston assembly operative to vary the vertical distance between said boom sheave and said load hook means in response to relative vertical movement between said first platform and said second platform, said cylinder secured to said boom means and said piston reciprocally operative therein to raise and lower said hook means independently of said winch, and (d) load sheave block means supporting said load hook means, wherein said piston is connected to a rod which supports a stationary sheave block and wherein said cable passes over said boom sheave and is reeved between said stationary sheave block and said load block means.

12. Load transfer apparatus comprising:

(a) boom means secured to a first platform and extending over a second platform, (b) hoist means comprising a winch, a boom sheave secured to said boom means above said second platform, and a cable secured to said winch and passing over said boom sheave to support load hook means above said second platform, and (c) relative vertical motion compensation means secured to said boom means comprising a cylinder and piston assembly operative to vary the vertical distance between said boom sheave and said load hook means in response to relative vertical movement between said first platform and said second platform wherein said cylinder is mounted substantially parallel with the longitudinal axis of said boom, said piston is connected to a piston rod extending from said cylinder and carries a sheave at the end thereof, and said cable passes over said boom sheave, through a travelling block, and through said sheave carried by said piston rod so that movement of said piston within said cylinder varies the vertical distance between said boom sheave and said travelling block.

13. Load transfer apparatus as defined in claim 12 including an idler sheave carried on said boom means to engage said cable between said travelling block and said sheave carried by said piston rod.

14. In a crane for transferring loads between a first platform and a second platform vertically movable with respect to each other and employing a boom supported by said first platform, a cable depending from said boom and supporting hook means, and winch means to move said cable, relative motion compensation apparatus comprising:

(a) cylinder means supported by said boom, (b) piston means mounted for vertical reciprocal movement in said cylinder, (c) first sheave means supported by said piston, (d) second sheave means supporting said hook means with said cable reeved between said first sheave means and said second sheave means, (e) sensing means for generating a signal proportional to relative vertical movement of said first platform and second platform, and (f) means responsive to said signal for supplying fluid to and removing fluid from said cylinder, thereby to raise and lower said piston in response to said signal.

15. In a crane for transferring loads between a first platform and a second platform vertically movable with respect to each other and employing a boom supported by said first platform, a cable depending from said boom and supporting hook means, and winch means to move said cable, relative motion compensation apparatus comprising:

(a) cylinder means mounted substantially parallel with said boom, (b) piston means mounted for reciprocal movement in said cylinder, (c) boom sheave means carried by said boom and over which said cable is drawn, (d) hook means supported by said cable depending from said boom sheave, (e) sheave means connected to said piston means and adapted to engage said cable between said boom sheave means and said hook means, (f) idler means carried by said boom to engage said cable between said hook means and said sheave means connected to said piston, (g) sensing means for generating a signal proportional to relative vertical movement of said first platform and second platform, and (h) means responsive to said signal for supplying fluid to and removing fluid from said cylinder, thereby to cause said piston means to move the piston connected sheave means and thereby move said hook means vertically with respect to said boom sheave in response to said signal.

* * * * *